US005731036A

United States Patent [19]

Battershell et al.

[11] Patent Number: 5,731,036

[45] Date of Patent: Mar. 24, 1998

[54] METHOD FOR PRESERVING WOOD

[75] Inventors: Robert D. Battershell, Painesville; Barry M. Jacobson, Pepper Pike; Ann C. Abraham, South Euclid; Belinda M. Pereira, Mayfield Heights; J. Vern Kempf, Chardon, all of Ohio

[73] Assignee: ISK Biosciences Corporation, Mentor, Ohio

[21] Appl. No.: 786,823

[22] Filed: Jan. 21, 1997

[51] Int. Cl.[6] ..... B05D 3/00; B05D 3/12; B05D 1/18

[52] U.S. Cl. ..... 427/297; 427/254; 427/354; 427/351; 427/440; 427/325

[58] Field of Search ..... 427/351, 254, 427/297, 325, 354, 440

[56] References Cited

U.S. PATENT DOCUMENTS

| | | | |
|---|---|---|---|
| 3,464,782 | 9/1969 | Ricard et al. | 427/254 |
| 4,243,675 | 1/1981 | Martin et al. | 514/483 |
| 4,759,872 | 7/1988 | Marx et al. | 252/400.53 |
| 4,859,787 | 8/1989 | Spiess et al. | 558/235 |
| 4,937,143 | 6/1990 | West | 427/419.8 |
| 5,024,861 | 6/1991 | Vinden et al. | 427/254 |
| 5,078,912 | 1/1992 | Goettsche et al. | 252/400.53 |
| 5,478,598 | 12/1995 | Shiozawa | 427/297 |
| 5,540,954 | 7/1996 | Nicholas et al. | 427/397 |

OTHER PUBLICATIONS

Abstract: Canessa et al., "Effect of Mixtures of Carbon Disulfide and Methylisothiocyanate on Survival of Wood–Colonizing Funji," Wood Fiber Sci., vol. 27, No. 3, pp. 207–224, 1995.

*Primary Examiner*—Shrive Beck
*Assistant Examiner*—Michael Barr
*Attorney, Agent, or Firm*—Thompson Hine & Flory LLP

[57] ABSTRACT

A method is described for preserving wood comprising infiltrating the wood with gaseous carbon disulfide and impregnating the wood with an aqueous solution comprising a copper source, and dimethylamine.

19 Claims, 1 Drawing Sheet

BLOCK FLOW DIAGRAM ILLUSTRATING THE PROCESS FOR PREPARING CDDS DIRECTLY IN WOOD

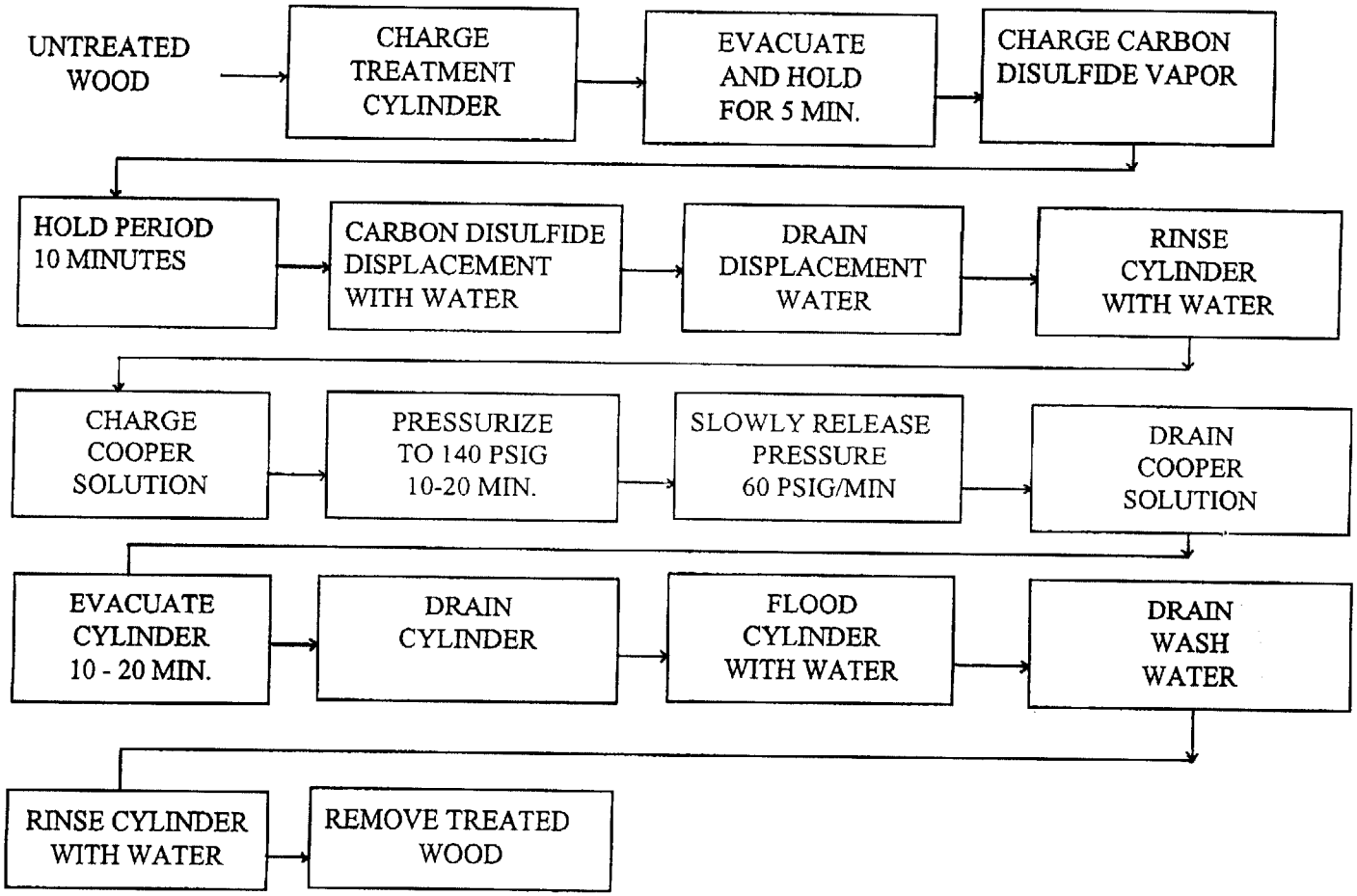
BLOCK FLOW DIAGRAM ILLUSTRATING THE PROCESS FOR PREPARING CDDS DIRECTLY IN WOOD

METHOD FOR PRESERVING WOOD

BACKGROUND OF THE INVENTION

The present invention relates to a method for the in situ preparation of copper dimethyldithiocarbamate, directly in wood.

A large number of wood preservatives are available for employment in one form or another to provide decay and insect protection for wood. A particularly effective wood preservative is copper dimethyldithiocarbamate (CDDC). The preparation of metal dialkyldithiocarbamates is known. For example, U.S. Pat. No. 4,859,787 to Spiess describes a process for the preparation of dialkyl-dithio-carbamates of multivalent metals by direct reaction of secondary amines with carbon disulfide and multivalent oxides such as lead oxide, zinc oxide, copper (II) oxide, iron (III) oxide, nickel (III) oxide, antimony (III) oxide and manganese dioxide. The process is carried out by adding a secondary amine and the metal oxide to a vessel containing a solvent which forms an azeotrope with water. Carbon disulfide is then added dropwise to the reaction vessel while stirring for a period of up to three hours. The mixture is then heated to reflux to remove the water formed by the reaction. However, in order for copper dimethyldithiocarbamate to be practical and effective as a wood preservative, it is desirable that it be formed directly in the wood matrix.

Presently, copper dimethyldithiocarbamate is prepared in situ by pressure treating wood with an aqueous copper-ethanol-amine solution and then with an aqueous solution of sodium dimethyldithiocarbamate (SDDC) to form copper dimethyldithiocarbamate directly in the wood. The sodium dimethyldithiocarbamate is prepared by contacting carbon disulfide with aqueous dimethylamine followed by the addition of caustic in a continuous reactor. For example U.S. Pat. No. 4,937,143 to West describes a two step method for preserving and coloring wood which comprises contacting the wood with an aqueous solution containing a copper compound such as copper ammonium carbonate and after this solution has sufficiently penetrated the wood, the wood is further treated with an aqueous solution of sodium dimethyldithiocarbamate. This process not only requires two separate steps but is time consuming and requires the use of expensive sodium dimethyldithiocarbamate as a raw material. Thus, it would be desirable to form the copper dimethyldithiocarbamate directly in the wood matrix without the need for expensive raw materials such as sodium dimethyldithiocarbamate and without the use of multiple reactors which require extended reaction time.

Accordingly, it is an object of the present invention to provide a process for preserving wood which utilizes relatively inexpensive raw materials.

It is another object of the present invention to provide a process for preserving wood which utilizes a single reactor.

It is still another object of the present invention to provide a process for preserving wood which utilizes an economically favorable reaction time.

It is yet another object of the present invention to provide a process for directly forming copper dimethyldithiocarbamate in situ in wood employing a single reactor which utilizes an economically favorable reaction time.

SUMMARY OF THE INVENTION

In accordance with the present invention, the above objects are accomplished by successively treating wood with carbon disulfide and then impregnating the carbon disulfide-treated wood with a solution of a copper compound and dimethylamine (DMA). The present invention which is useful to provide decay and insect protection and to provide color preservation in wood provides for the direct formation of copper dimethyldithiocarbamate in the wood matrix by infiltrating the wood with gaseous carbon disulfide and impregnating the $CS_2$-containing wood with an aqueous solution of a copper source and dimethylamine.

The formation of copper dimethyldithiocarbamate in accordance with the present invention is illustrated by the formula:

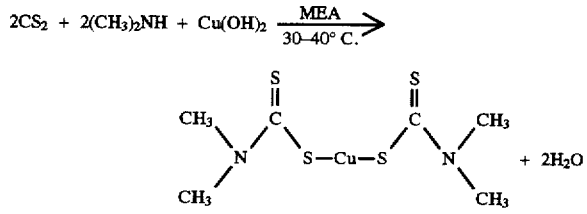

A major advantage of the present process over the prior art is the elimination for the need of expensive sodium dimethyldithiocarbamate as a raw material. Other advantages include a shorter reaction cycle time and the use of a single reactor for the entire process.

BRIEF DESCRIPTION OF THE DRAWING

The FIGURE is a block flow diagram illustrating the process of the present invention.

DETAILED DESCRIPTION OF THE INVENTION

In accordance with the invention a method for preserving wood comprises infiltrating the wood with gaseous carbon disulfide, and impregnation the wood with an aqueous solution of a copper source and dimethylamine. In the present process copper dimethyldithiocarbamate is formed directly in wood matrix by reacting carbon disulfide, dimethylamine and a water-soluble source of copper in situ in the wood being treated. The copper source is preferably an aqueous solution of copper hydroxide solubilized by a complexing agent such as monoethanolamine. The ratio of monoethanolamine to copper metal in the copper hydroxide is typically in the range of about 3.4 to 4.0 and, preferably about 3.9. Most preferably the copper hydroxide complexed with monoethanolamine is present as an aqueous solution. The concentration of copper (as copper metal) in the aqueous solution is about 0.8 to 1.2 wt. % and preferably about 0.9 to 1.1 wt. %. While copper hydroxide is preferred as the copper source, any copper source which forms a homogeneous copper solution and effectively reacts with dimethylamine to form an intermediate which then reacts with carbon disulfide to form copper dimethyldithiocarbamate can be utilized. Another source of copper, other than the preferred copper hydroxide complexed with monoethanolamine, is copper carbonate-copper hydroxide complexed with monoethanolamine or other suitable solubilizing agent.

While other metals such as zinc, antimony and the like may be useful in forming the respective dimethyldithiocarbamate, the applicability of such compounds in the preservation of wood may be undesirable because of possible toxic effects of such metals.

The solubilizing or complexing agent used in combination with the copper source is preferably monoethanolamine because it performs effectively as a solubilizing agent for copper hydroxide and it is also economically attractive. Other solubilizing or complexing agents may include diethanolamine, monopropanolamine, dipropanolamine etc., however, the cost of the higher alkanolamines appear to prohibit their use at the present time.

In accordance with the present invention other alkyl amines such as those having up to about 6 carbon atoms may be used to form other copper dialkydithiocarbamates.

The treatment of wood in accordance with the present invention is generally illustrated by a block flow diagram as shown in the FIGURE. The treatment begins with untreated wood being charged to the treatment cylinder. The cylinder is then closed, sealed and placed under vacuum and held at about 15 mm Hg for a predetermined period of time, preferably about five minutes. While the cylinder is at reduced pressure, carbon disulfide vapor is introduced into the cylinder at a temperature of about 50° to 55° C. for a sufficient time, preferably up to about 10 minutes and the pressure in the cylinder rises to approximately 500 mm Hg absolute pressure. The carbon disulfide vapor penetrates the wood during this period. During the carbon disulfide treatment, sufficient heat is applied to the bottom of the treatment cylinder to prevent condensation of the carbon disulfide or to vaporize any condensed carbon disulfide. A temperature greater than the boiling point of carbon disulfide, and preferably about 50°–55° C. is sufficient to maintain the carbon disulfide in the vapor state.

At the end of the carbon disulfide treatment, the cylinder is flooded with water to remove carbon disulfide vapor. Preferably, the flood water has been previously saturated with carbon disulfide to minimize diffusion of the carbon disulfide from the wood. The carbon disulfide vapor removed from the cylinder is condensed and recycled to the next treatment batch. The carbon disulfide-treated wood is then impregnated with a copper solution under elevated pressure, preferably about 90 to 140 psig. Typically, the copper treatment is performed at room temperature. Since the pressure of residual carbon disulfide in the treated wood may present a fire or explosive hazard, a slight excess of the copper-dimethylamine solution is desirable to ensure the complete reaction of all the carbon disulfide. At the completion of the copper treatment, the pressure is slowly released from the cylinder (about 60 psig/minute) and the copper solution drained from the treatment vessel. The cylinder is then evacuated for a sufficient period of time to remove any residual liquid from the wood. Generally, about 10 to 20 minutes is sufficient to remove the contained liquid depending upon the size of the vessel and the amount and type of wood being treated. As a result of the treatment, the wood typically increases in weight up to approximately 50%, most of which is water from the copper solution.

During the wood treatment a small amount of copper dimethyldithiocarbamate solids typically forms outside the wood. As a result, these solids may contaminate the liquid streams leaving the treatment cylinder, especially in the copper treating solution. To prevent the solids from contaminating the liquid streams and to minimize the need to clean the treatment equipment, all of the streams leaving the treatment cylinder should be filtered.

The present invention provides a method for preserving wood against decay and insect infestation and providing color preservation of wood. The invention is useful in both hardwoods such as oaks, ashes, maples, basswoods, poplars and gums; and softwoods such as coniferous woods, e.g., pines, spruces, hemlocks and firs. The present invention is particularly useful in the preservation of pine wood, e.g., southern yellow pine wood.

On a commercial scale the method of the present invention is conducted using a treatment cylinder of a size which is economically practical and convenient.

The present invention is illustrated in more detail by the following non-limited example.

EXAMPLE

Description of Process Activity and Cycle Time

Table 1 provides a listing of the required activities and estimated completion times for the treatment of wood with copper dimethyldithiocarbamate. A typical treatment cycle is estimated to require approximately two hours.

TABLE 1

WOOD TREATMENT PROCESS BATCH CYCLE

| Activity | Cycle Time (approximate) minutes |
|---|---|
| Charge wood and Seal Cylinder | 10 |
| Evacuate Cylinder and Hold for 5 minutes | 10 |
| Charge Carbon Disulfide | 5 |
| Carbon Disulfide Hold Period | 10 |
| Carbon Disulfide Water Displacement | 5 |
| Drain Displacement Water | 5 |
| Water Rinse Treatment Cylinder | 2 |
| Charge Copper Solution | 5 |
| Copper Solution Hold Period | 15 |
| Slow Pressure Release | 3 |
| Drain Copper Solution | 5 |
| Evacuate Cylinder | 20 |
| Wash Treated Wood with Water | 5 |
| Drain Wash Water | 5 |
| Water Rinse Treatment Cylinder | 5 |
| Remove Treated Wood | 10 |
| Total Treatment Cycle Time | 120 |

Description of the Treatment Vessel

This example is conducted in a treatment cylinder which is 2 feet in length internally, with an inner diameter of 3 ⅜". A tee is configured at the top of the reactor so that aspirator vacuum may be applied, and $CS_2$ can be introduced into the reactor. Heat tape is wrapped around the $CS_2$ inlet to keep it at 90° C. (the temperature will drop to about 60° C. during the $CS_2$ addition). The cylinder itself typically is in two pieces that have been machined so that they can be bolted together. Heat tape is attached along the bottom of the reactor to maintain a skin temperature at or above the boiling point of carbon disulfide. Rings with spokes that radiate outwardly to touch the sides of the reactor are used to keep the wood from floating or touching the bottom of the reactor (where it might come into contact with liquid $CS_2$). Inside the reactor, a glass tee has been inserted at the inlet to the reaction chamber to ensure that any $CS_2$ that condenses or otherwise is not vaporized, during the addition, will drip down the walls of the reactor and be vaporized without touching the wood. On one end of the reactor, a tee has been constructed near the floor of the reactor, so that the aqueous streams can be conveniently introduced to and emptied from the reactor by gravity. Valves have been placed on the ends of the tee with the one that is used to introduce fluids pointing up and the one used for draining fluids pointing downward. Another tee has been constructed at the other end of the reactor. This tee is used for venting $CS_2$ vapor out of the reactor, for releasing vacuum, and for pressurizing the reactor. A three-way valve is configured in the middle of the tee. In the first position, it is connected to a nitrogen cylinder and regulator which can be set to the desired pressure. In the second position it is closed, and in the third position, it vents to the atmosphere through a dry ice trap designed to catch $CS_2$ vapor. A vacuum/pressure gauge is also attached to the reactor.

Description of Wood Treatment

A piece of southern yellow pine wood (approximately 1⅜"×1⅜×24") is charged to the reactor and held in place with the rings. The reactor is sealed and an aspirator vacuum is established. The timer is started at this point. Vacuum is held for 5 min before the aspirator is disconnected and $CS_2$ is added to the cylinder over a period of about 2 min. There is a 10 min hold time timed from the beginning of the $CS_2$ addition. At the end of the hold period the vacuum is released, and water that has been saturated with carbon disulfide is flooded into the reactor to condense and displace all $CS_2$ liquid and vapor. It is important to perform the $CS_2$ saturated water flush as quickly as possible. If the wood is allowed to warm up too much, not enough $CS_2$ will remain absorbed. The water is drained, and the reactor is filled with a copper solution made up by combining 159.3 g of copper hydroxide (56% copper, by weight), 351 g monoethanolamine (MEA), 450 g of 40% dimethylamine (DMA) and deionized water to make a 9 L solution. Nitrogen pressure (150 psig) is applied for at least 10 minutes and then released by 60 lb/min or slower as the fluid is drained (the pressure will fall off rapidly at first and will be much slower after the first minute or two). Vacuum is established once again and held for at least 10 minutes. Any excess fluid is drained and a water rinse is done. The reactor is opened and the treated wood is removed, rinsed and allowed to air dry on the lab bench.

Having described the invention in detail, it will be appreciated that the present specification and claims are provided as means of illustration of the invention and not limitation, and that various modifications and changes may be made without departing from the spirit and scope of the present invention.

What is claimed is:

1. A method for preserving wood comprising infiltrating the wood with gaseous carbon disulfide, and impregnating the wood with an aqueous solution of a copper source and dimethylamine, wherein said carbon disulfide, said copper source and said dimethylamine are employed in sufficient amounts to form copper dimethyldithiocarbamate in the wood.

2. The method of claim 1 of wherein the copper source comprises copper hydroxide and a solubilizing agent.

3. The method of claim 2 wherein the solubilizing agent is monoethanolamine.

4. The method of claim 1 wherein the wood is infiltrated in a first stage with said carbon disulfide under a subatmospheric pressure and impregnated in a second stage with said aqueous solution under superatmospheric pressure.

5. The method of claim 4 wherein prior to infiltrating the wood with gaseous carbon disulfide, the wood is held at a subatmospheric pressure for about 5 minutes.

6. The method of claim 5 wherein the wood is infiltrated in the first stage with carbon disulfide at a temperature of about 50° to 55° C.

7. The method of claim 3 wherein the weight ratio of monoethanolamine to copper in said aqueous solution is about 3.4 to 4.0.

8. The method of claim 1 wherein the copper concentration in said aqueous solution is about 0.8 to 1.2 wt. %.

9. The method of claim 1 wherein the wood is a softwood.

10. The method of claim 9 wherein the wood is southern yellow pine.

11. A method for preserving wood comprising the steps of:

(a) charging one or more pieces of wood to a treatment reactor;

(b) closing and sealing said reactor;

(c) applying vacuum to said reactor;'

(d) introducing gaseous carbon disulfide to said reactor;

(e) flooding the reactor with water to remove carbon disulfide vapors;

(f) removing the flood water from the reactor;

(g) charging the reactor with an aqueous solution comprising copper hydroxide, monoethanoline, and dimethylamine;

(h) pressuring the reactor to about 140 psig with nitrogen;

(i) evacuating the reactor;

(j) washing the treated wood with water; and (k) drying the treated wood, wherein said carbon disulfide, said monoethanolamine, said copper hydroxide, and said dimethylamine are employed in sufficient amounts to form copper dimethyldithiocarbamate in the wood.

12. The method of claim 11 wherein the weight ratio of monoethanol to copper is said aqueous solution is about 3.4 to 4.0.

13. The method of claim 11 wherein the copper concentration in said aqueous solution is about 0.8 to 1.2 wt. %.

14. The method of claim 11 wherein said wood is a softwood.

15. The method of claim 14 wherein said wood is southern yellow pine.

16. A method for forming dimethyldithiocarbamate directly in a wood matrix comprising infiltrating the wood matrix with gaseous carbon disulfide at subatmospheric pressure and impregnating the carbon disulfide-infiltrated wood matrix with an aqueous solution of a source of copper, monoethanolamine, and dimethylamine at superatmospheric pressure, wherein said carbon disulfide, said monoethanolamine, said source of copper, and said dimethylamine are employed in sufficient amounts to form said copper dimethyldithiocarbamate in the wood.

17. The method of claim 16 wherein the weight ratio of monoethanolamine to copper is said aqueous solution is about 3.4 to 4.0.

18. The method of claim 16 wherein the copper concentration in said aqueous solution is about 0.8 to 1.2 wt. %.

19. The method of claim 16 wherein said source of copper is copper hydroxide.

* * * * *